United States Patent [19]

Awerkamp

[11] Patent Number: 4,492,537

[45] Date of Patent: Jan. 8, 1985

[54] FLUID-OPERATED OIL OR WATER WELL PUMP

[76] Inventor: John B. Awerkamp, 720 N. 2nd St., Quincy, Ill. 62301

[21] Appl. No.: 448,719

[22] Filed: Dec. 10, 1982

[51] Int. Cl.[3] ..... F04B 47/08

[52] U.S. Cl. ..... 417/404

[58] Field of Search ..... 417/397, 403, 404

[56] References Cited

U.S. PATENT DOCUMENTS

| | | | |
|---|---|---|---|
| 1,907,949 | 5/1933 | Gage | 417/403 X |
| 2,118,547 | 5/1938 | Carlisle | 417/404 |
| 2,697,985 | 12/1954 | Carlisle | 417/404 |
| 2,948,224 | 8/1960 | Bailey et al. | 417/404 X |
| 3,522,996 | 8/1970 | Bentley et al. | 417/404 |
| 4,118,154 | 10/1978 | Roeder | 417/404 |
| 4,406,598 | 9/1983 | Walling | 417/404 |

*Primary Examiner*—Leonard E. Smith

*Attorney, Agent, or Firm*—Birch, Stewart, Kolasch & Birch

[57] ABSTRACT

A fluid operated pump for use in a vertical orientation includes an outer casing with a closure member disposed at one end thereof. A piston is operatively mounted for reciprocation within the outer casing and defines a first fluid chamber between the closure member, the outer housing and a first face of the piston. A first casing is provided at a point spaced from the closure of the housing. A second fluid chamber is formed between the outer housing, the first casing and a second face of the piston. A rod member is operatively disposed for reciprocation within the outer housing. The first piston member is affixed to one end of the rod member. A second casing is provided which is spaced at a predetermined distance from the first casing. A chamber is defined between the outer housing and the first and second casings. A plurality of tubes having inner and outer surfaces are disposed within the chamber and define a plurality of fluid passages between the inner and outer surfaces and the first and second casings. A third and fourth casing are operatively positioned at a predetermined distance with respect to each other within an inner tube disposed within said chamber. A working pump chamber is defined between the third and fourth casings and the inner tube. A second piston member is affixed to the rod and is operatively disposed within the working pump chamber. An inlet conduit is in communication with one of said plurality of fluid passages for supplying fluid to said working pump chamber. An outlet conduit is in communication with one of said fluid passages for discharging fluid from the working pump chamber. Pressurized fluid is in communication with at least one of said plurality of fluid passages for selectively supplying fluid to said first and second fluid chambers to impart movement to said first piston member. Imparting movement to said first piston member imparts movement to the rod to reciprocate the second piston member. Reciprocating the second piston member within the working pump chamber supplies fluid to a first working chamber while discharging fluid from a second working chamber.

21 Claims, 18 Drawing Figures

FLUID-OPERATED OIL OR WATER WELL PUMP

BACKGROUND OF THE INVENTION

1. Field of the Invention

The present invention relates to a fluid operated pump which is adaptable for use in a vertical orientation.

2. BRIEF DESCRIPTION OF THE PRIOR ART

Hithertofore, it has been difficult to pump fluid from a vertical well. Prior art pumps have not been successfully developed for pumping either oil or water from a well casing when the pump is positioned in a vertical orientation.

SUMMARY AND OBJECTS OF THE PRESENT INVENTION

It is an object of the present invention to provide a fluid operated pump which is adapted to pump a fluid from a well casing when the pump is disposed in a vertical orientation.

A further object of the present invention is to provide a fluid-operated pump which is capable of readily pumping oil or water from a well casing.

Another object of the present invention is to provide a fluid-operated pump which is easy to install and remove from the well casing.

A further object of the present invention is to provide a fluid-operated pump which may be readily positioned within a well casing by hoisting equipment which would include a top mounted roller divided into three sections to accommodate and separate a steel cable, oil discharge hose and air pressure input hose.

A further object of the present invention is to provide a fluid-operated pump which includes a lifting eye for connection to a cable which may be easily connected to a power winch or pulled by a vehicle to raise or lower the fluid-operated pump into a well casing.

These and other objects of the present invention are accomplished by a fluid-operated pump having an outer housing and being closed at a first end thereof. A first piston member is operatively positioned within the outer housing and defines a first fluid chamber between the closure, the outer housing and a first face of the first piston member. A rod member is operatively mounted for reciprocation within the outer housing and is affixed to the first piston member at one end thereof. A first casing is positioned within the outer housing adjacent to the first piston member and defines a second fluid chamber therebetween. A second casing is positioned at a predetermined distance from said first casing and defines a chamber between the outer housing and the first and second casings. A plurality of tubes having inner and outer surfaces are disposed within the chamber and define a plurality of fluid passages between the inner and outer surface and the first and second casings. A third and fourth casing are positioned at a predetermined distance with respect to each other within an inner tube disposed in the chamber and defining a working pump chamber therebetween. A second piston member is affixed to the rod and is operatively disposed within the working pump chamber. An inlet conduit is provided being in communication with one of said plurality of fluid passages for supplying fluid to said working pump chamber. An outlet conduit is provided in communication with one of said plurality of fluid passages for discharging fluid from said working pump chamber. Pressurized fluid is in communication with at least one of said plurality of fluid passages for selectively supplying fluid to said first and second fluid chambers to impart movement to said first piston member. Imparting movement to the first piston member reciprocates the rod and the second piston member for supplying fluid to the working pump chamber and simultaneously discharging fluid therefrom.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1A:
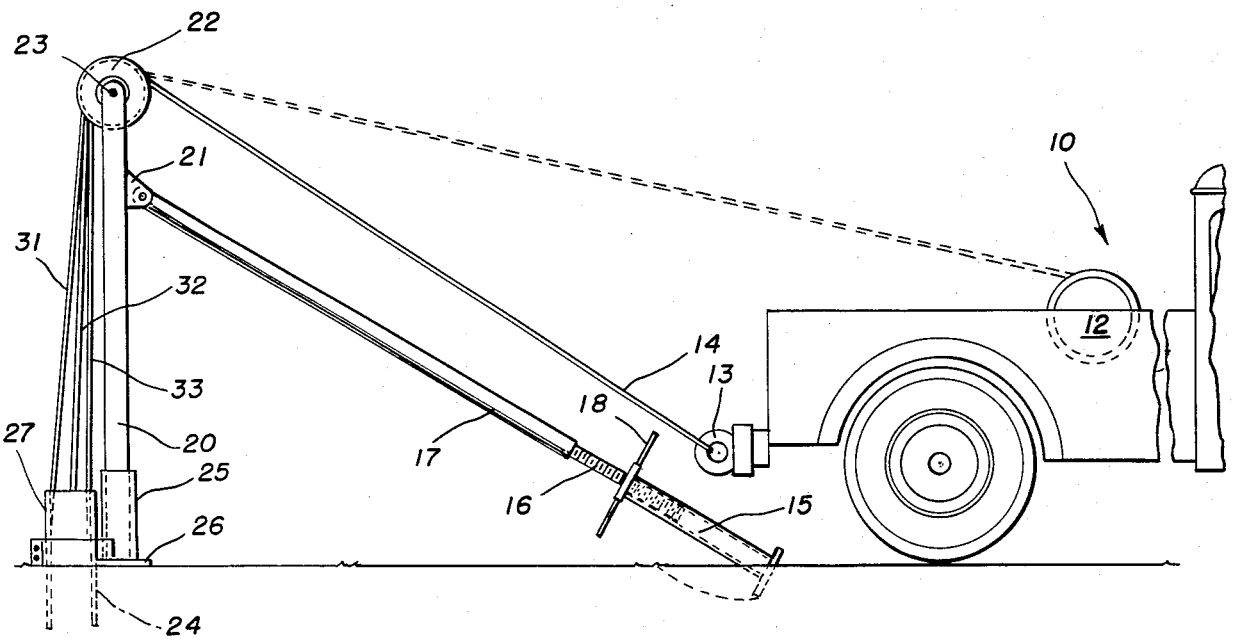
FIG. 1A is a side view illustrating a pump hoisting mechanism for use in combination with the present invention.
Figure 1B:
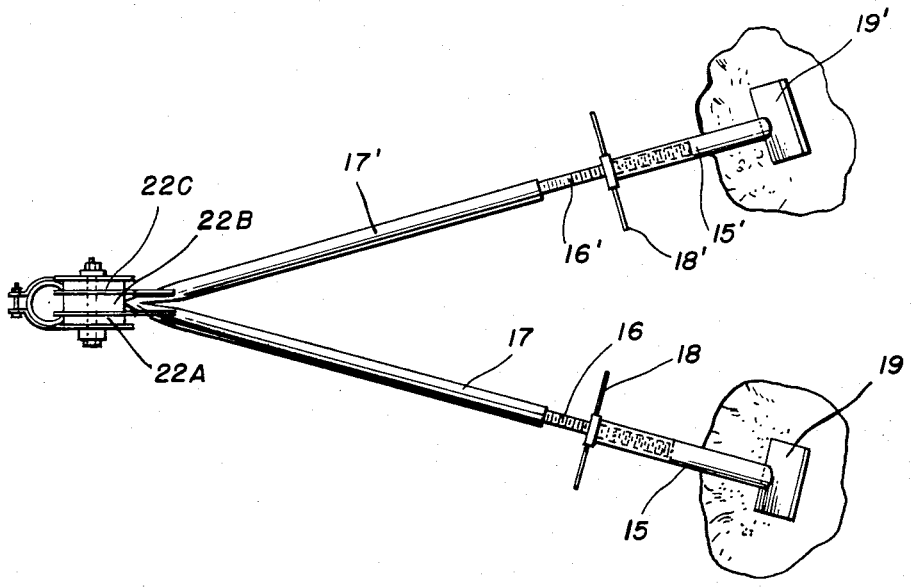
FIG. 1B is a top plan view of the pump hoisting mechanism illustrated in FIG. 1A.

As illustrated in FIGS. 1A and 1B, the present invention is directed to a fluid operated pump which is designed to be lowered into a well casing. The pump hoisting mechanism may include a truck 10 with a winch mechanism 12 mounted thereon. Of course, a winch mechanism may be independently disposed apart from a truck body for raising and lowering the fluid operated pump within the well casing.

Support arms 17, 17' include a threaded section 16, 16' which is threadedly received within a support rod 15, 15'. The support rods 15, 15' are anchored to the ground surface by means of the anchor supports 19, 19'. A vertical support rod 20 is positioned within a housing 25 mounted on the ground surface by means of a base member 26. The support rod 20 includes a flange 21 to which the support arms 17, 17' are operatively mounted. A roller 22 is mounted to the support rod 20 by means of the axle 23. The roller 22 is divided into three sections 22A, 22B and 22C. The three sections support the oil or water hose 31, the steel cable 32 and the air hose 33 so that they are separated with respect to each other as the fluid-operated pump is raised or lowered with respect to the well casing 24, 27.

The truck 10 may include a support eye 13. The cable 32 may be affixed between the support eye 13 and the pump to raise and lower the pump within the well casing 24, 27. In a second mode of operation, the cable 32 may be independently connected to a winch, not shown in the drawings, to raise and lower the pump within the well casing 24, 27. The support arms 17, 17' may be adjusted relative to the anchor members 19, 19' by rotating the adjustment members 18, 18'.

Figure 2A:
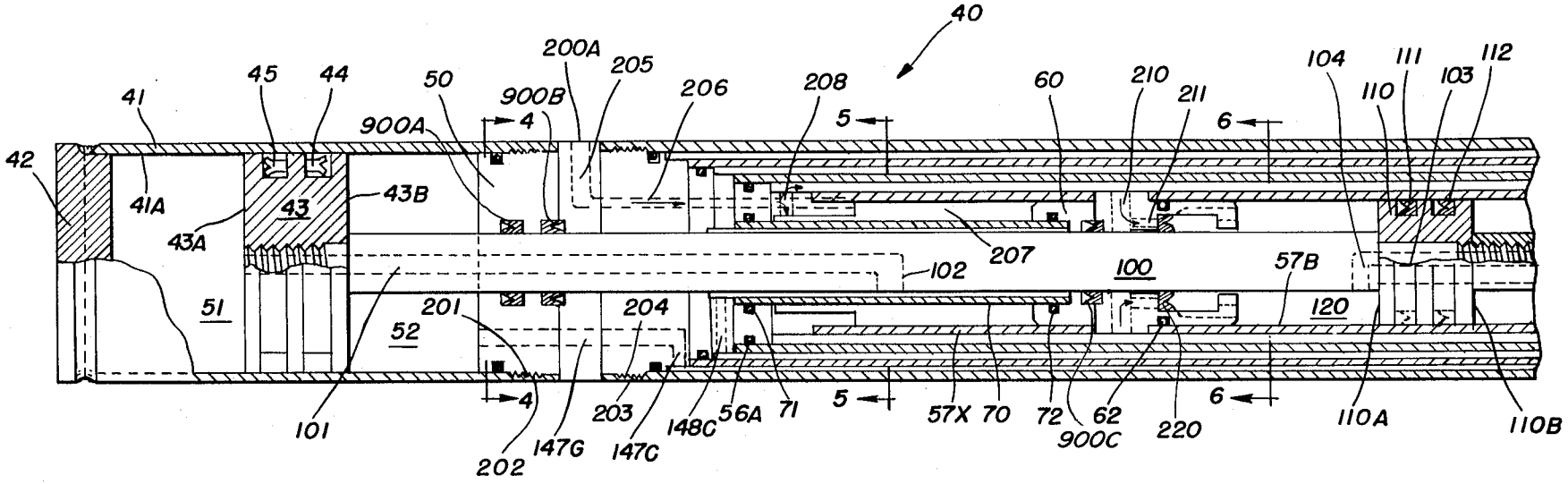
FIG. 2A is a partial cross-sectional view illustrating a lower portion of fluid pump according to the present invention.
Figure 2B:
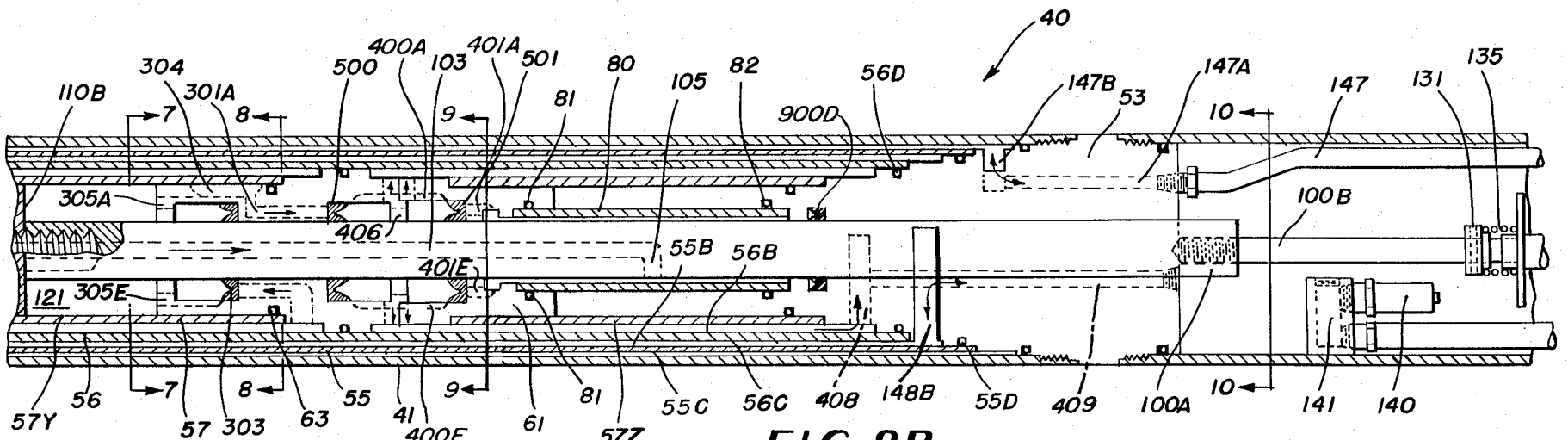
FIG. 2B is a cross-sectional view illustrating an intermediate portion of the fluid pump according to the present invention.
Figure 2C:
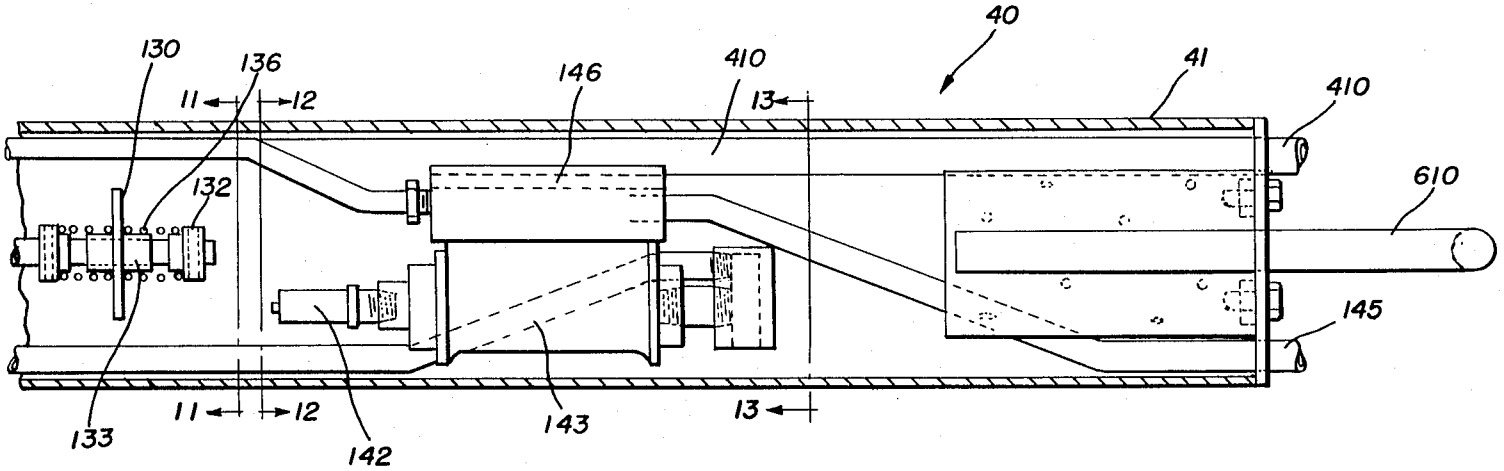
FIG. 2C is a partial cross-sectional view illustrating an upper portion of a fluid pump according to the present invention.

FIGS. 2A, 2B and 2C together define the fluid-operated pump of the present invention. The fluid-operated pump has been broken into three sections to more clearly illustrate the various components of the pump. The fluid operated pump 40 includes an outer housing 41 with a closure member 42 disposed at one end thereof. The closure member 42 may be actually welded to the outer housing 41 to provide an airtight closure for a first end of the outer housing 41.

A first piston 43 is operatively mounted within the outer housing 41. The first piston 43 includes a first face 43A and a second face 43B. Circular U-cup seals 44, 45 are provided around the peripheral surface of the first piston 43. The U-cup seals 44, 45 ensure a fluid tight engagement between the first piston 43 and an inner surface 41A of the outer housing 41.

A first casing 50 is mounted within the outer housing 41 and is spaced at a predetermined distance from the closure 42. The first piston 43 is mounted for reciprocation between the closure 42 and the first casing 50. A first fluid chamber 51 is disposed between a first face 43A of the first piston 43, the inner surface 41A of the outer housing 41 and the closure 42. A second fluid chamber 52 is provided between a second face 43B of the first piston 43, and inner surface 41A of the outer housing 41 and the first casing 50.

A second casing 53 is mounted within the outer casing 41 and spaced a predetermined distance from the first casing 50. A chamber is formed between the first casing 50, the inner surface 41A of the outer housing 41 and the second casing 53. A plurality of tubes are disposed within the chamber and define a plurality of fluid passages between inner and outer surfaces of the tubes and the first casing 50 and the second casing 53. A first tube 55 is the largest diameter of the plurality of tubes disposed between the first casing 50 and the second casing 53. The first tube 55 is mounted on the first casing 50 and includes an O-ring 55A to seal the inner surface 55B and the outer surface 55C with respect to the first casing 50. The first tube 55 is sealed to the second casing 53 and includes an O-ring 55D to ensure a fluid tight seal therebetween.

A second tube 56 is disposed between the first casing 50 and the second casing 53. The second tube 56 includes an O-ring seal 56A to ensure the fluid tight seal between the first casing 50 and the second tube 56. The second tube 56 includes an inner wall 56B and an outer wall 56C. An O-ring seal 56D is provided between the inner tube 56 and the second casing 53 to ensure a fluid tight seal therebetween.

The third tube 57 is broken into three sections, 57X, 57Y and 57Z. The first section 57X is mounted to the first casing 50. The third section 57Z is mounted to the second casing 53. Operatively positioned between the first casing 50 and the second casing 53 are a third casing 60 and a fourth casing 61. The first section 57X is secured to the third casing 60 at a second end thereof. The second section 57Y is secured at one end to the third casing 60 and at a second end to the fourth casing 61. The third section 57Z is secured at one end to the fourth casing 61. O-ring seals 62, 63 are provided to ensure a fluid tight seal between the second section 57Y relative to the third casing 60 and the fourth casing 61, respectively.

A fourth tube 70 is operatively mounted between the first casing 50 and the third casing 60. O-ring seals 71, 72 are provided to ensure a fluid tight seal between the first casing 50, the fourth tube 70 and the third casing 60, respectively. In addition, a fifth tube 80 is operatively mounted between the fourth casing 61 and the second casing 53. O-ring seals 81, 82 are provided between the fourth casing 61, the fifth tube 80 and the second casing 53, respectively.

A rod 100 is operatively mounted for reciprocation within the outer housing 41 and includes seals 900A, 900B, 900C and 900D for sealing the outer surfaces of the rod 100 as the rod is reciprocated within the first casing 50, the second casing 53, the third casing 60 and the fourth casing 61. The rod 100 is affixed at one end to the first piston 43. A fluid channel 101 is operatively positioned within the thickness of the rod member 100 and includes a radially disposed portion 102. Fluid may be supplied to the first fluid chamber 51 through the fluid channel 101 and the radial portion 102.

The rod 100 is affixed to a second piston 110 which is operatively mounted within a working chamber disposed between the inner surface of the second section 57Y of the third tube 57 and the third and fourth casings 60, 61. The second piston 110 includes U-cup seals 111, 112 which ensure a fluid tight relationship between the second piston 110 and an inner surface 57B of the third tube 57. A second fluid channel 103 is provided within the thickness of the rod 100 and includes radial portions 104 and 105. A first working pump chamber 120 is provided between the third casing 60, the inner surface 57B of the third tube 57 and a first face 110A of the second piston 110. A second working pump chamber 121 is provided between the fourth casing 61, the inner surface 57B of the third tube 57 and a second face 110B of the second piston 110.

Figure 10:
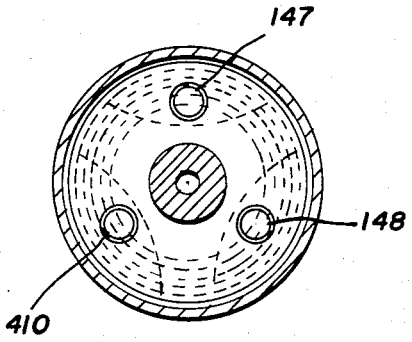
FIG. 10 is a cross-sectional view taken along lines 10—10 as illustrated in FIG. 2B.
Figure 11:
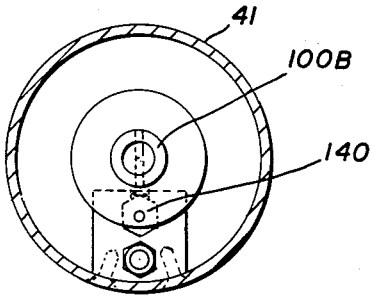
FIG. 11 is a cross-sectional view taken along lines 11—11 as illustrated in FIG. 2C.
Figure 12:
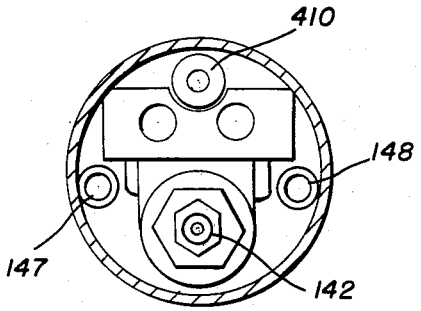
FIG. 12 is a cross-sectional view taken along lines 12—12 as illustrated in FIG. 2C.
Figure 13:
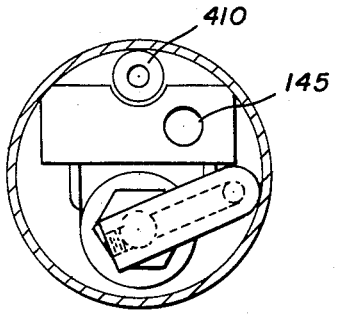
FIG. 13 is a cross-sectional view taken along lines 13—13 as illustrated in FIG. 2C.

The rod 100 includes an end portion 100A which is affixed to a second portion of the rod 100B. The second portion of the rod 100B includes an activating member 130 mounted at one end thereof. The activating member 130 is affixed to a rod portion 133 mounted for reciprocation on the rod 100B. A spring 135 is mounted between the activating member 130 and an end stop 131. A spring 136 is mounted between the activating member 130 and an end member 132. A pilot bleed valve 140 is operatively mounted to a conduit to 141 and is adapted to be selectively opened when engaged by the activating member 130. A second pilot bleed valve 142 is operatively mounted to a four-way inner valve 143 and is adapted to selectively open a conduit when engaged by the activating member 130. A supply of pressurized fluid is provided through the conduit 145 to the valve manifold 146. The pressurized fluid is thereafter supplied to the conduit 147 for communication to the fluid operated pump 40. A second fluid pressure conduit 148 as illustrated in FIG. 10 is provided for selectively supplying pressurized fluid to the fluid operated pump 40. The four-way air valve 143 selectively communicates fluid to either the conduit 147 or the conduit 148. The pilot bleed valves 140, 142 selectively exhaust the pressurized fluid from either the conduit 147 or the conduit 148 as the rod 100 reciprocates within the outer housing 41.

As illustrated in FIGS. 2A, 2B, 2C and 10–13, pressurized fluid is supplied through the conduit 145, through the valve manifold 146 to the conduit 147. A fluid passage 147A is provided in the second casing 53 and includes an radially disposed portion 147B. The fluid is thereafter supplied to the space between an inner surface 41A of the outer housing 41 and an outer surface 55C of the first tube 55. The fluid is communicated along the outer housing 41 to radially disposed passages 147C–147F positioned in the first casing 50. The radially disposed fluid passages 147C–147F are in communication with fluid conduits 147G–147J which supply pressurized fluid to the second fluid chamber 52.

Selectively, the pilot bleed valves 140, 142 may exhaust fluid from the second fluid chamber 52 by venting the pressurized fluid supplied to the space between the inner surface 41A of the outer housing 41 and the outer surface 55C of the first tube 55 to the atmosphere. As the second fluid chamber 52 is vented to the atmosphere, pressurized fluid is supplied through the conduit 148 and through a passageway extending longitudinally through the second casing 53. A radially extending passage 148B is provided to communicate fluid to a space between an inner surface 55B of the first tube 55 and an outer surface 56C of the second tube 56. The pressurized fluid is supplied along the outer housing 41 to a radially extending passageway 148C. The fluid thereafter is supplied to the space between the fourth tube 70 and the rod 100. The fluid thereafter communicates with the radially extending portion 102 and the fluid channel 101 to supply pressurized fluid to the first fluid chamber 51. Thereafter, as the first piston 43 is reciprocated towards the first casing 50, the activating member 130 engages the pilot bleed valve 142 to discharge the pressurized fluid from the first fluid chamber 51 and reconnect the pressurized fluid to the second fluid chamber 52.

By selectively supplying fluid to the first fluid chamber 51 while discharging fluid from the second fluid chamber 52 and thereafter supplying pressurized fluid to the second fluid chamber 52 while discharging fluid from the first fluid chamber 51 imparts reciprocation to the first piston 43 which imparts reciprocation to the rod 100 and the piston 110.

The second piston 110 is reciprocated within the working chamber which is divided into a first working pump chamber 120 and a second working pump chamber 121.

Figure 4:
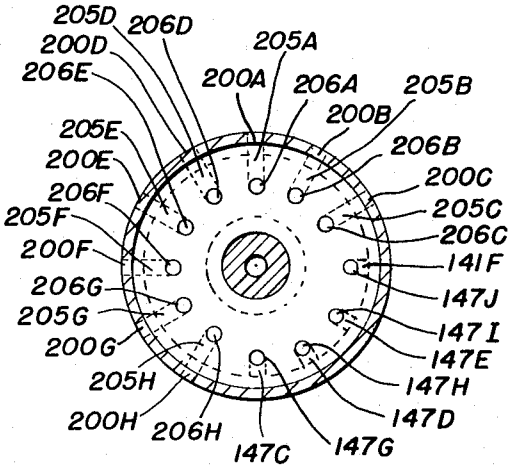
FIG. 4 is a cross-sectional view taken along lines 4—4 as illustrated in FIG. 2A.
Figure 3:
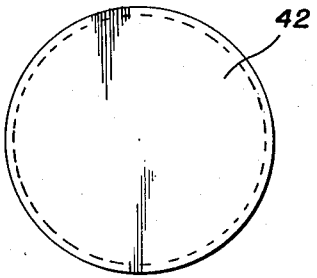
FIG. 3 is an end view of the lower portion of the fluid operated pump.

As illustrated in FIGS. 2A and 4, the first casing 50 includes a plurality of inlet openings 200A–200H. The first casing 50 includes a threaded portion 201 which mates with a threaded portion 202 of the outer housing 41. In addition, the first casing 50 includes a second threaded portion 203 which mates with a second threaded portion 204 of the outer housing 41. The inlet openings 200A–200H are disposed around the peripheral surface of the first casing 50 in a space between the first threaded portion 202 and the second threaded portion 203.

Figure 5:
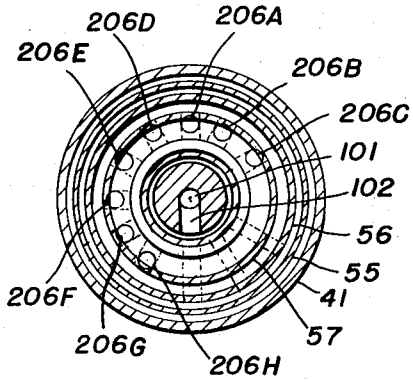
FIG. 5 is a cross-sectional view taken along lines 5—5 as illustrated in FIG. 2A.
Figure 6:
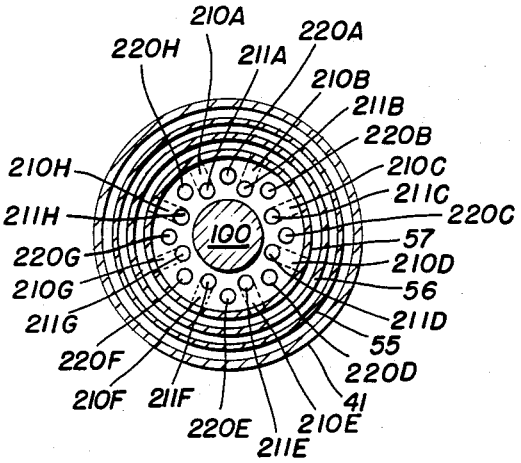
FIG. 6 is a cross-sectional view taken along lines 6—6 as illustrated in FIG. 2A.

Fluid to be pumped from a well casing is supplied through the inlet openings 200A–200H to a radially disposed conduits 205A–205H, respectively. The radially disposed conduits 205A–205H are in communication with a longitudinally extending conduit 206A–206H, respectively. The longitudinally extending conduits extend through an end portion of the first casing 50 and terminate in conduit openings 206A–206H as illustrated in FIG. 5. The conduit openings 206A–206H communicate fluid into the chamber 207 disposed between the fourth tube 70 and the first section 57X of the third tube 57. In addition, radially disposed conduit 208 communicates fluid from the inlets 200A–200H to a passageway defined between an outer surface of the first section 57X and the second 57Y of the third tube 57 and an inner surface 56B of the second tube 56. The fluid is communicated along this fluid passageway to the third casing 60. Radially extending passages 210 communicate fluid from the longitudinally extending passage to the third casing 60. The third casing 60 includes a plurality of radially extending passages 210A–210H. The radially extending passages communicate with a plurality of longitudinally extending passages 211A–211H. The longitudinally extending passages 211A–211H communicate pressurized fluid to the U-cup valve seal 220. The pressurized fluid lifts the U-cup valve seal 220 from the seal seat to a new position to open inlet and outlet passages for the flow of fluid. This permits fluid to enter the longitudinally extending passages 220A–220H in the third casing 60. As illustrated in FIGS. 2A and 6, the passageways 210A–210H, 211A–211H and 220A–220H are in fluid communication with the passageway defined between the outer surface of the first section 57X of the third tube 57 and the inner surface 56B of the second tube 56.

Figure 7:
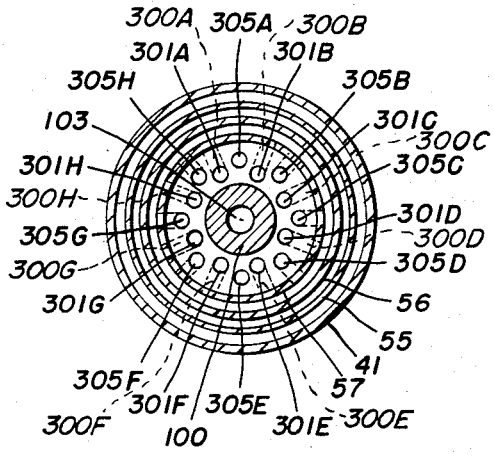
FIG. 7 is a cross-sectional view taken along lines 7—7 as illustrated in FIG. 2B.
Figure 8:
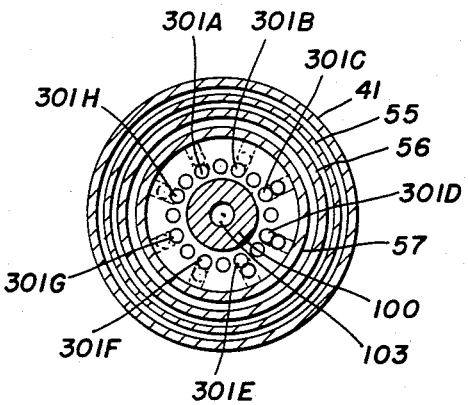
FIG. 8 is a cross-sectional view taken along lines 8—8 as illustrated in FIG. 2B.
Figure 9:
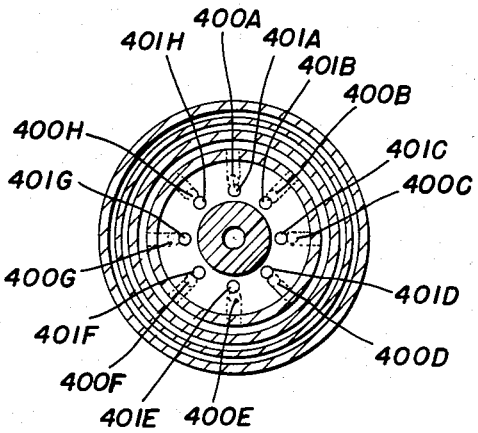
FIG. 9 is a cross-sectional view taken along lines 9—9 as illustrated in FIG. 2B.

Fluid from the inlet openings 200A–200H is also in communication with radially disposed conduits in the fourth casing 61. As illustrated in FIGS. 2B and 7, the radially disposed conduits 300A–300H are in communication with the longitudinally extending passages 301A–301H. The fluid in the longitudinally extending passages 301A–301H is supplied against one side of the U-cup valve seal 303. The pressurized fluid lifts the U-cup valve seal 303 from the seal seat to a new position to open inlet and outlet passages for the flow of In addition, a longitudinally extending passage 304 is provided adjacent an upper surface of the fourth casing 61 for directly communicating fluid from selective longitudinally extending passages 301A–301H to the passages 305A–305H. Further, the fourth casing 61 as illustrated in FIGS. 2B and 9, includes passageways 400A–400H which are in communication with a chamber 406. In addition, passageways 401A–401H communicate fluid to a space defined between the rod 100 and an inner surface of the tube 80. Further, fluid is communicated between the chamber 406 and an inner surface 56B of the second tube 56 and an outer surface of the third section 57Z of the third tube 57. The fluid in the passageway between the inner surface 56B of the second tube 56 and the third section 57Z of the third tube 57 is communicated to a radially extending passage 408 which communicates with a longitudinally extending passage 409 connected to a discharge conduit 410 for discharging fluid from the working chambers 120, 121.

As illustrated in FIG. 2B, the fourth casing 61 includes U-cup valve seals 500, 501 which are disposed on opposite sides of the chamber 400. As pressurized fluid is supplied one side of the U-cup valve seal 500, it lifts the U-cup valve seal from the seal seat to a new position to open inlet and outlet passaes for the flow of fluid. This permits fluid to flow into the chamber 406. Similarly, as pressurized fluid is supplied to one side of the U-cup valve seal 501, it lifts the U-cup valve seal from the seal seat to a new position to open inlet and outlet passages for the flow of fluid. This permits fluid to flow into the chamber 406. The U-cup valve seals 500, 501 function independently to either permit or prevent fluid to enter the chamber 406.

Figure 14:
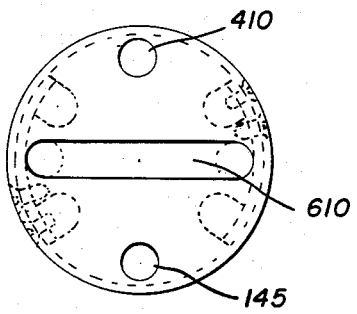
FIG. 14 is an end view of the top portion of the fluid-operated pump as illustrated 2C.
Figure 15:
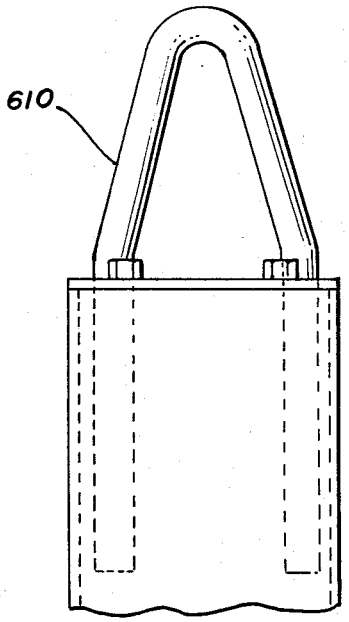
FIG. 15 is a side view of the end portion of the fluid-operated pump as illustrated in FIGS. 2C and 14.

FIGS. 10–13 disclose the conduits 147, 148 and 410 which either supply pressurized fluid or discharge fluid from the fluid operated pump. FIGS. 14 and 15 illustrate an end view of the fluid-operated pump outer housing. The outer housing includes an eye 610 for connection to a cable. The eye 610 is substantially V-shaped.

OPERATION

In operation, pressurized fluid is supplied through the conduit 145 to the valve manifold 146. Thereafter, fluid is supplied to either the conduit 147 or the conduit 148. As fluid is supplied to the conduit 147, it communicates through the passage 147A and the radially extending passage 147B to the space defined between the inner surface 41A of the outer housing 41 and an outer surface 55C of the first tube 55. The fluid is communicated along the outer housing 41 to the radially extending passages 147C–147F and the longitudinally extending passages 147G–147J in the first casing 50 to the second fluid chamber 52. At the same time, pressurized fluid is exhausted from the first fluid chamber 51. In this first mode of operation, the pressurized fluid in the second fluid chamber 52 forces the first piston 43 towards the left as illustrated in FIG. 2A, to reciprocate the rod 100 and the second piston 110. As the second piston 110 is reciprocated towards the left, fluid within the first working pump chamber 120 is sealed therein by means of the U-cup valve seal 220. The fluid in the first working chamber 120 can only be discharged through the radially extending passage 104, the longitudinally extending passage 103 and the radially extending passage 105. The fluid is thereafter disposed between the rod 100 and an inner surface of the tube 80. The fluid communicates through the passageways 401A–401H to the chamber 406 where it is communicated to the space between the outer surface of the third section 57Z of the third tube 57 and the inner surface 56B of the second tube 56. Thereafter, the fluid is communicated to the radially extending passage 408 and the longitudinally passage 409 in the second casing 53. The fluid in the longitudinally passage 409 is communicated to the discharge conduit 410 to supply the fluid through the well casing to the surface.

As the fluid is discharged from the first working pump chamber 120, additional fluid is supplied from the inlet passageways 200A–200H through the radially extending passageways 205A–205H to the longitudinally extending passages 206A–206H to the chamber 207. The fluid in the chamber 207 extends through the radially extending passages 210A–210H to the space between the outer surface of the first section 57X of the third tube 57 and the inner surface 56B of the second tube 56. The fluid in this passage is communicated through the radially extending passages 300A–300H to the longitudinally extending passages 305A–305H and is sucked past the U-cup valve seal 303 into the second working pump chamber 121.

As the first piston 43 reaches the closure 42 of the outer housing 41, the activating mechanism 130 engages the pilot bleed valve 140 to discharge pressurized fluid from the second fluid chamber 52 through the same passageway that the pressurized fluid was supplied thereto. At this point in time, pressurized fluid is then connected to the conduit 148 and is supplied to the radially extending passageway to the space between the inner surface 55*b* of the first tube 55 and the outer surface 56*c* of the second tube 56. The pressurized fluid is communicated along the fluid pump to the radially extending passage 148*c* to the space between the tube 70 and the rod 100. Fluid is then communicated through the radially extending passage 102 and the longitudinally extending passage 101 to the first fluid chamber 51. Pressurized fluid in the first fluid chamber 51 imparts movement to the first piston 43 to reciprocate the rod 100 and the second piston 110 towards the right as illustrated in FIGS. 2A and 2B. Reciprocating the second piston 110 towards the right discharges fluid from the second working chamber 121 through the passages 304A–304H to the passages 301A–301H passed the U-cup seal 500 to the chamber 406. Fluid in the chamber 406 is communicated to the space between the inner surface 56*b* of the second tube 56 and the outer surface of the third section 57Z of the third tube 57. The fluid in this passageway is communicated through the radially extending passage 408 to the longitudinally extending passage 409 in the second casing 53. Fluid in the longitudinally extending passage 409 is communicated to the discharge conduit 410 to discharge fluid from the second working pump chamber.

As fluid is discharged from the second working pump chamber 121, fluid is sucked into the first working pump chamber 120. Fluid is communicated through the inlet passageways 200A–200H to the radially extending passageways 205A–205H to the longitudinally extending passageways 206A–206H to the chamber 207. Thereafter, fluid is supplied to the space between the inner surface 56B of the second tube 56 and the outer surface of the first section 57X of the third tube 57. The fluid is communicated through the passageways 210A–210H and the passageways 211A–211H to the one side of the U-cup valve seal 220 and through the passageways 220A–220H to the first working pump chamber 120.

The U-cup valve seals disposed along the rod 100 are normally arranged in pairs to seal the rod 100 relative to the respective casings. The U-cup valve seals 220, 303, 500, and 501 have a snug fit on the rod 100 and a free fit on the interior portion of the respective casings. As pressure is selectively applied to one side of the U-cup valve seals 500 and 501, the seals are biased away from the fourth casing to permit fluid to flow therebetween. As suction is applied to one side of the U-cup valve seals 220 and 303, the seals are biased away from the third casing and the fourth casing, respectively, to permit fluid to flow therebetween. Holes may be provided between the U-cup valve seals 220, 303, 500 and 501 and their respective casings to permit material to pass on the outer surface of the U-cup valve seals.

The fluid operated pump of the present invention may be operated by utilizing either hydraulic fluid or pressurized air. If hydraulic fluid is used to impart movement to the piston 43, it will be necessary to employ an exhaust conduct (not illustrated). Exhausted hydraulic fluid from either the fluid chamber 51 or 52 will pass through the pump housing and into the exhaust conduit to be conveyed upwardly to ground level. If pressurized air is utilized to impart movement to the piston 43, an exhaust conduct is not necessary.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A fluid operated pump adaptable for use in a vertical orientation comprising:

an outer housing including a closure mounted adjacent a first end thereof;

a rod operatively mounted for reciprocation within said outer housing and including first and second ends;

a first piston member affixed to a first end of said rod and being operatively disposed within said outer housing adjacent said closure and defining a first fluid chamber therebetween;

a first casing being positioned within said outer housing adjacent to said piston member and defining a second fluid chamber therebetween;

a second casing being positioned at a predetermined distance from said first casing and defining a chamber between said outer housing and said first and second casings;

a plurality of tubes having inner and outer surfaces being disposed within said chamber and defining a plurality of fluid passages between said inner and outer surfaces and said first and second casings;

a third and fourth casing being positioned at a predetermined distance within an inner tube of said plurality of tubes being disposed in said chamber and defining a working pump chamber therebetween;

a second piston member being affixed to said rod and being operatively disposed within said working pump chamber;

an inlet conduit being in communication with one of said plurality of fluid passages for supplying fluid to said working pump chamber;

an outlet conduit being in communication with one of said plurality of fluid passages for discharging fluid from said working pump chamber;

pressurized fluid being in communication with at least one of said plurality of fluid passages for selectively supplying fluid to said first and second fluid chambers to impart movement to said first piston member;

whereby selectively supplying pressurized fluid to said first and second fluid chambers imparts reciprocation to said first piston member which imparts reciprocation to said rod and said second piston member for supplying fluid to said working pump chamber and simultaneously discharging fluid therefrom.

2. A fluid operated pump according to claim 1, wherein said rod is reciprocatably mounted within said first, second, third and fourth casings and U-cup seals are provided within said casings to provide a tight seal against an outer surface of said rod.

3. A fluid operated pump according to claim 1, wherein said pressurized fluid is air.

4. A fluid operated pump according to claim 1, wherein a pair of oppositely facing U-cup seals are operatively positioned within said first casing and being in engagement with said rod to provide a fluid tight seal when said rod is reciprocated.

5. A fluid operated pump according to claim 1, wherein a first and second oppositely facing U-cup valve seals are operatively positioned within said third casing and are in engagement with said rod, said first U-cup valve seal providing a seal when said rod is reciprocated in a first direction while said second U-cup valve seal permits fluid flow through a passage in said third casing and said second U-cup valve seal providing a fluid tight seal when said rod is reciprocated in a second direction.

6. A fluid operated pump according to claim 1, wherein a third, fourth and fifth U-cup valve seals are operatively positioned within said fourth casing and are in engagement with said rod, said third. and fifth U-cup valve seals providing a seal when said rod is reciprocated in a first direction while said fourth U-cup valve seal permits fluid flow through a passage in said fourth casing and said fourth U-cup valve seal providing a fluid tight seal when said rod is reciprocated in a second direction while said fifth U-cup valve seal permits fluid flow through a passage in said fourth casing.

7. A fluid operated pump according to claim 1, wherein a U-cup seal is operatively positioned in said second casing and being in engagement with said rod to provide a fluid tight seal therebetween.

8. A fluid operated pump according to claim 1, wherein U-cup seals are provided on outer peripheral surfaces of said first and second pistons to provide a fluid tight seal with said outer housing.

9. A fluid operated pump according to claim 1, and further including a four way fluid valve for directing pressurized fluid to said first and second fluid chambers.

10. A fluid operated pump according to claim 1, and further including an activating member affixed to said rod for selectively engaging a first exhaust valve for exhausting pressurized fluid from said second fluid chamber when said rod is reciprocated in a first direction and for selectively engaging a second exhaust valve for exhausting pressurized fluid from said first fluid chamber when said rod is reciprocated in a second direction.

11. A fluid operated pump according to claim 1, wherein said pressurized fluid is hydraulic fluid.

12. A fluid operated pump according to claim 1, wherein a first pressurized fluid passageway is provided through a longitudinal and at least one radial passageway in said second casing, through a space formed between an inner surface of said outer housing and a first tube, through at least one radial and a corresponding number of longitudinal passageways in said first casing to supply pressurized fluid to said second fluid chamber.

13. A fluid operated pump according to claim 12, wherein said first tube is the largest diameter tube with respect to said plurality of tubes.

14. A fluid operated pump according to claim 1, wherein a second pressurized fluid passageway is provided through a second longitudinal and at least one second radial passage in said second casing, through a space formed between an inner surface of a first tube and an outer surface of a second tube, through at least one radial passageway in said first casing, through a space formed between an outer surface of said rod and an inner surface of a fourth tube, through a radial and a longitudinal passageway in said rod, through an opening in said first piston to supply pressurized fluid to said first fluid chamber.

15. A fluid operated pump according to claim 14, wherein said second tube is of a smaller diameter with respect to said first tube and is larger in diameter with respect to the remaining plurality of tubes.

16. A fluid operated pump according to claim 14, wherein said fourth tube is the smallest diameter tube with respect to said plurality of tubes and is disposed in close spaced relationship to said rod.

17. A fluid operated pump according to claim 1, wherein said working pump chamber includes a first working pump chamber and a second working pump chamber.

18. A fluid operated pump according to claim 17, wherein fluid positioned within said second working pump chamber is discharged through at least one longitudinal passageway in said fourth casing, through a U-cup valve seal being in sealing engagement with said rod and being disposed in said fourth casing, to a chamber disposed in said fourth casing, through at heast one radial passage in said fourth casing, to a space formed between an inner surface of a second tube and an outer surface of a third tube, through a radial and a longituginal passageway in said second casing to a discharge conduit to discharge fluid from said second working pump chamber when pressurized fluid is supplied to said first fluid chamber.

19. A fluid operated pump according to claim 17, wherein fluid positioned within said first working pump chamber is discharged through a radial and a longitudinal passageway in said rod and in said second piston, through a radial passage in said rod to a space formed between an outer surface of said rod and an inner surface of a fifth tube, through a U-cup valve seal being in sealing engagement with said rod and being disposed in said fourth casing, to a chamber disposed in said fourth casing, through at least one radial passage in said fourth casing, to a space formed between an inner surface of a second tube and an outer surface of a third tube, through a radial and a longitudinal passageway in said second casing to a discharge conduit to discharge fluid from said first working pump chamber when pressurized fluid is supplied to said second fluid chamber.

20. A fluid operated pump according to claim 19, wherein said fifth tube is the smallest diameter tube with respect to said plurality of tubes and is disposed in close spaced relationship to said rod.

21. A fluid operated pump according to claim 19, wherein said third tube is larger in diameter with respect to said fifth tube and smaller in diameter with respect to the remaining plurality of tubes.

* * * * *